US007324005B2

(12) United States Patent
Stoof

(10) Patent No.: US 7,324,005 B2
(45) Date of Patent: Jan. 29, 2008

(54) MODULAR SURGE PROTECTION

(76) Inventor: Ronald M. Stoof, P.O. Box 101624, Pittsburgh, PA (US) 15237

( * ) Notice: Subject to any disclaimer, the term of this patent is extended or adjusted under 35 U.S.C. 154(b) by 191 days.

(21) Appl. No.: 11/118,607

(22) Filed: Apr. 28, 2005

(65) Prior Publication Data

US 2005/0270726 A1 Dec. 8, 2005

Related U.S. Application Data

(60) Provisional application No. 60/566,631, filed on Apr. 28, 2004.

(51) Int. Cl.
*G08B 21/00* (2006.01)

(52) U.S. Cl. ..... 340/639; 340/638

(58) Field of Classification Search ..... 340/638, 340/639, 644, 649, 650, 662, 663, 502, 506; 455/418, 420; 711/114; 714/18; 700/231
See application file for complete search history.

(56) References Cited

U.S. PATENT DOCUMENTS 4,162,536 A * 7/1979 Morley ..... 714/18
4,907,119 A 3/1990 Allina
4,945,450 A 7/1990 Sabatella et al.
5,283,553 A 2/1994 Ishii et al.
5,506,570 A * 4/1996 Scott et al. ..... 340/603
5,694,326 A * 12/1997 Warn et al. ..... 700/231
5,774,317 A 6/1998 Allina
5,877,691 A 3/1999 Suptitz et al.
5,956,223 A 9/1999 Banting
6,076,142 A * 6/2000 Corrington et al. ..... 711/114
6,246,928 B1 6/2001 Louis et al.
6,254,434 B1 7/2001 Steeves
6,394,847 B2 * 5/2002 Law ..... 439/620.27
6,765,787 B2 * 7/2004 Beasley et al. ..... 361/641
7,005,996 B2 * 2/2006 Cabrera et al. ..... 340/639
7,158,781 B2 * 1/2007 Garnett et al. ..... 455/418

OTHER PUBLICATIONS

"IT Protector", IT Innovative Technology, Product Brochure, 2003.
"Lightning & Surge Protection Power Conditioning Catalogue" Powerhouse Electronics, Fourth Edition, date unknown.

* cited by examiner

*Primary Examiner*—Van T. Trieu
(74) *Attorney, Agent, or Firm*—Carothers & Carothers

(57) ABSTRACT

A power protection system for protection against an electrical transient surge and/or interference. Such a system can be useful in the dispensing of fuel at gas stations, convenience stores, truck stops, and other such locations, for protection of the low voltage signal wires that go from the dispenser to the store. Broadly contemplated are modular arrangements where removal of a corrupted module in a cabinet containing several modules will still keep the general communications circuit intact. Particularly contemplated are modules which include integral fuses and indicator lights.

15 Claims, 14 Drawing Sheets

System Layout with Trendar Unit

30

60
62
64

20

System Layout with Trendar Unit

System Layout with Trendar Unit

We want protection to go before the Trendar single module unit

Picture showing 11:53 and 11

This would be the G-Site computers

Shown in picture with 10:56

We want our protection to go in before the D-Box

Base of this is junction box shown on split picture

Fuel PC System Setup

Formerly CRIND (COM settings are defaults)

RESISTOR 3R3 3W 5%

GAS BATTERY 90V G2-G1

TRANSORB 1.5KE 12CA T1 – T7

TECHNICAL DETAIL.

MODULAR SURGE PROTECTION

CROSS-REFERENCE TO RELATED U.S. APPLICATION

This application claims priority under 35 U.S.C. 119(e) from U.S. Provisional Patent Application Ser. No. 60/566,631, filed on Apr. 28, 2004.

FIELD OF THE INVENTION

The present invention generally relates to surge protection, and particularly to surge protection in retail fuel dispensing settings and analogous settings.

BACKGROUND OF THE INVENTION

With reference to the retail convenience store and self-serve fuel dispensing industry, sophisticated equipment is normally used to monitor, control and automate the dispensing of fuel based products, and to register payment for such purchases. Similar equipment is often used at automatic car washes.

These fuel dispensers and analogous systems are monitored via control equipment (e.g. computers, cash registers, etc.) that is usually housed in an office, kiosk or equipment room. The physical location of the control equipment can typically range from a few feet up to several hundred feet away from the dispensing or other equipment (e.g. pumps, credit card readers, etc.).

As a result of this distance between the dispensing (or other) operations and the control equipment, the electronic circuitry and electrical equipment is subject to surges and transient interference. For example, surges and transient interference may originate in the power transmission wires, from cell-phone transmission or communications cables (for example, intercoms), or even from electrical storms.

At present, arrangements for preventing (or obviating) surges and transient interference, to avoid damaging the equipment circuitry, are relatively rudimentary. For example, in at least one conventional arrangement, power protection has been placed on the incoming power point to the computers, and over-voltage protection is fitted into the main distribution board. Where communication via RS 232 lines is utilized, data protection products can be retro-fitted into each line. For example, an RS 232 interface board can be fitted to the 12V DC single lines. In some instances, telephone lines are protected with standard telephone line lightning protection equipment.

Generally, conventional efforts have fallen far short in terms of providing the type and degree of surge (or interference) protection that is desired or needed, especially in terms of attenuating any potential economic impact brought about by surges or interference. Accordingly, a significant need has been recognized in connection with improving upon the shortcomings and disadvantages of such conventional arrangements.

SUMMARY OF THE INVENTION

Generally, there is broadly contemplated herein a power protection system for protection against an electrical transient surge and/or interference. Such a system can be useful in the dispensing of fuel at gas stations, convenience stores, truck stops, and other such locations, for protection of the low voltage signal wires that go from the dispenser to the store. Broadly contemplated are modular arrangements where removal of a corrupted module in a cabinet containing several modules will still keep the general communications circuit intact. Particularly contemplated are modules which include integral fuses and indicator lights.

In summary, there is broadly contemplated herein, in accordance with at least one presently preferred embodiment of the present invention, power protection arrangement comprising: an assembly comprising at least one modular base assembly; at least one power protection module adapted to be docked at and removable from the at least one modular base assembly; and at least one visual indicator corresponding to the at least one power protection module, the at least one visual indicator being adapted to indicate a state of communicative integrity between the assembly and at least one remote communications point; the assembly being adapted to maintain or reestablish circuit integrity upon removal of at least one the power protection module from at least one the modular base assembly.

Further, there is broadly contemplated herein, in accordance with at least one presently preferred embodiment of the present invention, a power protection module comprising: a module body; an arrangement for facilitating integration of the module body with a modular base assembly; and at least one of: at least one visual indicator physically integrated with the module body, the visual indicator being adapted to indicate a state of communicative integrity between a modular base assembly and at least one remote communications point; and at least one fuse physically integrated with the module body.

Additionally, there is broadly contemplated herein, in accordance with at least one presently preferred embodiment of the present invention, a power protection arrangement comprising: an assembly comprising at least one modular base assembly; and at least one power protection module adapted to be docked at and removable from said at least one modular base assembly; said assembly being adapted to maintain or reestablish circuit integrity upon removal of at least one said power protection module from at least one said modular base assembly.

BRIEF DESCRIPTION OF THE DRAWINGS

The present invention and its presently preferred embodiments will be better understood by way of reference to the detailed disclosure herebelow and to the accompanying drawings, wherein.

DETAILED DESCRIPTION OF THE PRESENTLY PREFERRED EMBODIMENTS OF THE INVENTION

Figure 1:
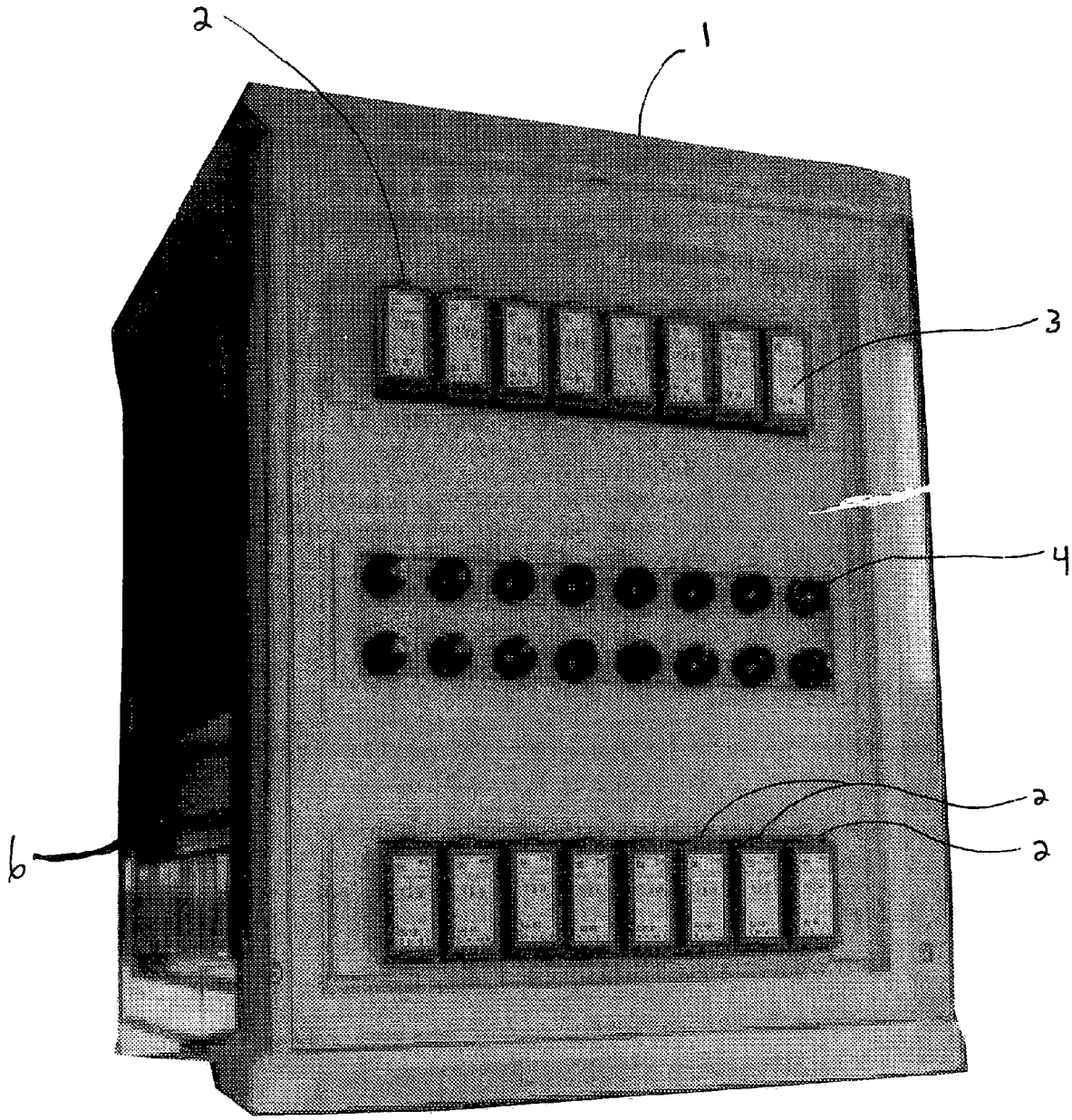
FIG. 1 is a picture of a "Low Voltage Power Protection System" ("LVPPS").

The present discussion will first address a general setup in accordance with at least one embodiment of the present invention, and will then turn to an overview of some refined features that may be employed.

The purpose of an LVPPS, in accordance with at least one embodiment of the present invention, is to reduce and/or eliminate the potential damaging effects of transient voltage surges and high frequency line noise on the low voltage wires (for example, the wires that connect a distant fuel dispenser and the control electronics inside a centralized location, such as the store and/or kiosk). Such wires are typically low voltage in that they carry a 12-volt signal. When transient voltage surges occur, such surges may reach high voltages, for example into the 1000-volt plus range.

Acute transient voltage surges and continual lower voltage surges, if not reduced or eliminated, will cause reduced life expectancy or failure of the control electronics that are associated with these signals. It is desirable, therefore, to provide an LVPPS for protection against electrical transient surges and/or interference.

The surge protection components and methodology incorporated into an LVPPS in accordance with the invention provide necessary protection for the low voltage signal wires (e.g. 12-volt levels) that go between a dispenser and control electronics inside a store and/or kiosk. The protection is preferably implemented through the use of a Unique Transient Voltage Surge Protection Module (hereinafter "UTVSPM" or "Module"). Preferably, and with reference to FIG. 1, such a module 3 can be placed into a hardwired socket that is in series with the signal lines being protected. The sockets are preferably mounted in a unitary assembly, for example, a wall-mountable box 1. Preferably, this box (unitary assembly) has a see-through plastic front cover 6 allowing for a visual inspection of the interior to monitor indication of any failure in a module (e.g. loss of continuity in a circuit) for example, through the extinguishing of an indicator light. Preferably, each module 3 includes an indicator light 2 that turns off when the module 3 fails (i.e., loses continuity). It is further contemplated that the LVPPS will be configured such that, upon removal of a module 3, the circuit is immediately reestablished to once again regain its operational characteristics (albeit with no surge protection for that circuit) and a new module 3 can be subsequently inserted into the hardwired socket to restore the surge protection.

It is further contemplated that fuse protection 4, 5 may be added to the LVPPS. This provides desirable over voltage and short circuit protection to prevent damage to the system.

It is contemplated that one unitary assembly (e.g., a wall-mountable box) of the LVPPS will contain a plurality of Modules such that the LVPPS is capable of protecting multiple (e.g. 4 to 16) dispensers and/or card readers.

It is further contemplated that the LVPPS will be compatible with electronic systems that are current in use, for example, compatible to the known Tokheim Dispensers and Control Electronics arrangements, and that such systems can be easily retrofitted with the LVPPS.

It is also contemplated that the LVPPS will be compatible with the known Wayne and Gilbarco systems, with certain minimal modifications to provide the necessary number of wires or voltage levels.

FIG. 1 is a picture of an LVPPS in accordance with an embodiment of the present invention.

Figure 2:
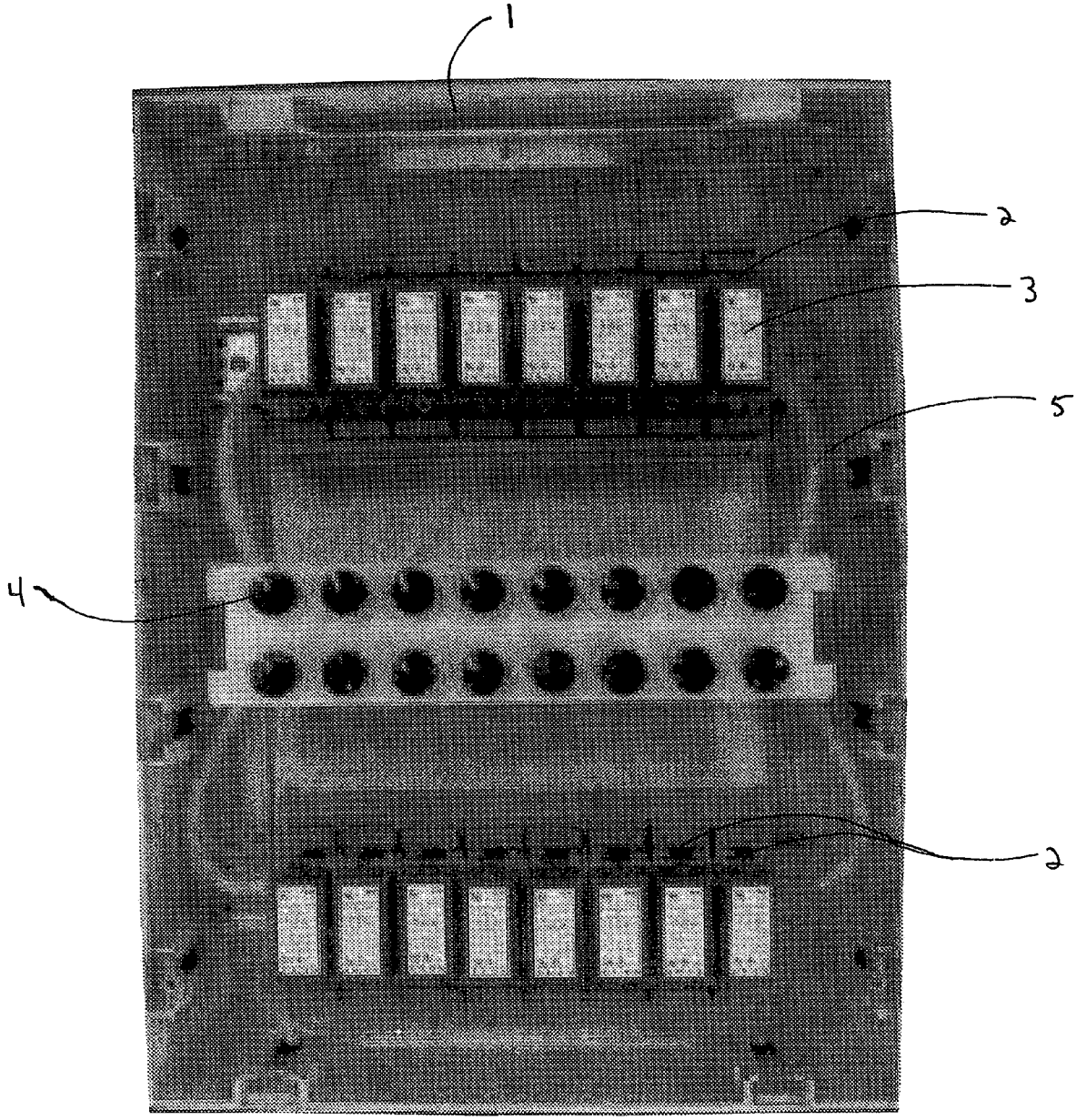
FIG. 2 is a picture of the LVPPS showing fusing, a module and wiring.

FIG. 2 is a picture of an LVPPS showing fusing, a module and wiring, in accordance with an embodiment of the present invention.

Figure 3:
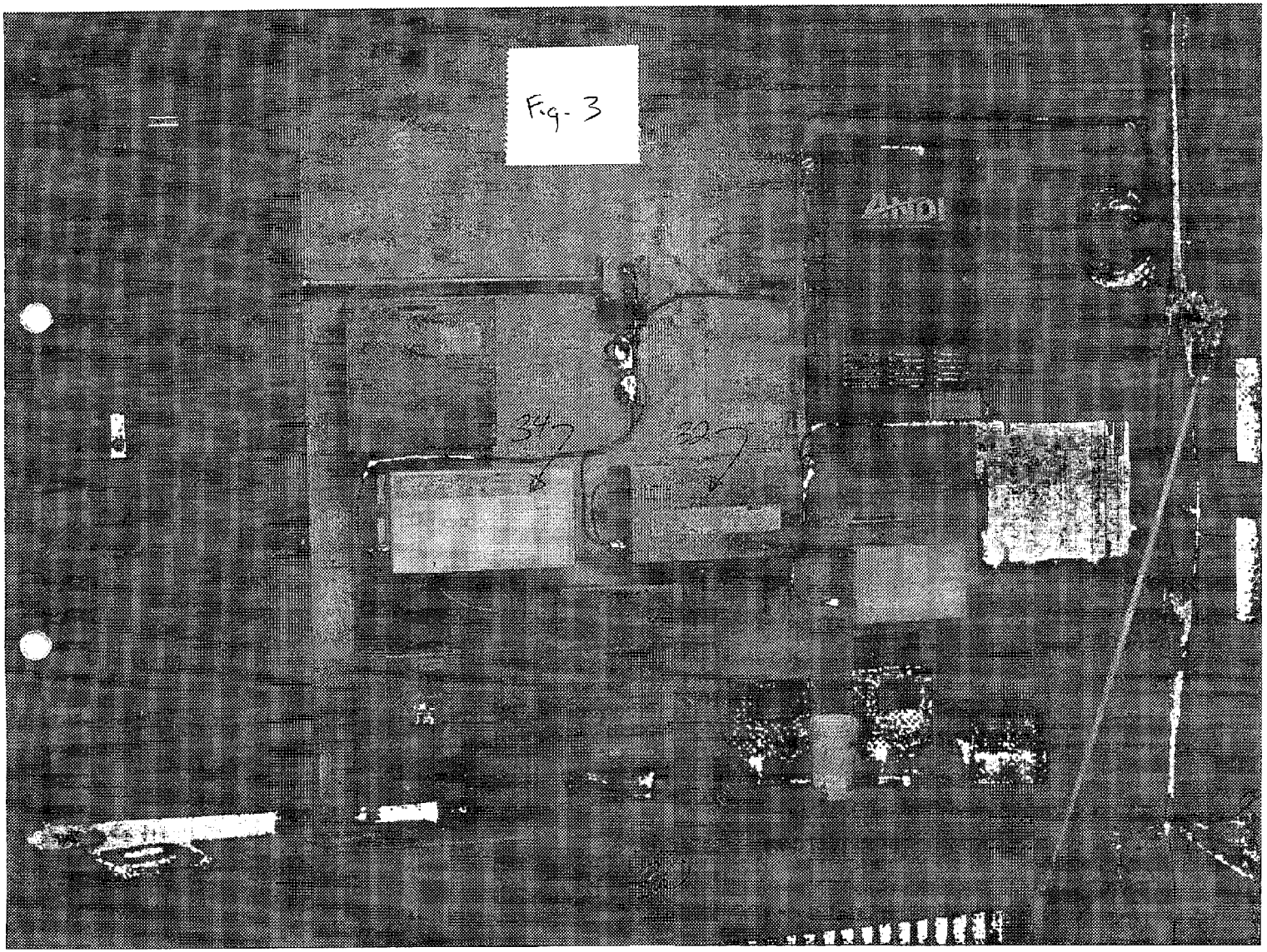
FIG. 3 is a picture of a typical layout of electrical systems, components and controllers for a gas station having remote dispensers.

FIG. 3 is a picture of a typical "Gilbarco" layout of electrical systems, components and controllers for a gas station having remote dispensers. The wire trough 30, shown at the bottom of the picture, contains incoming wires 40 from the dispensing units.

Figure 4:
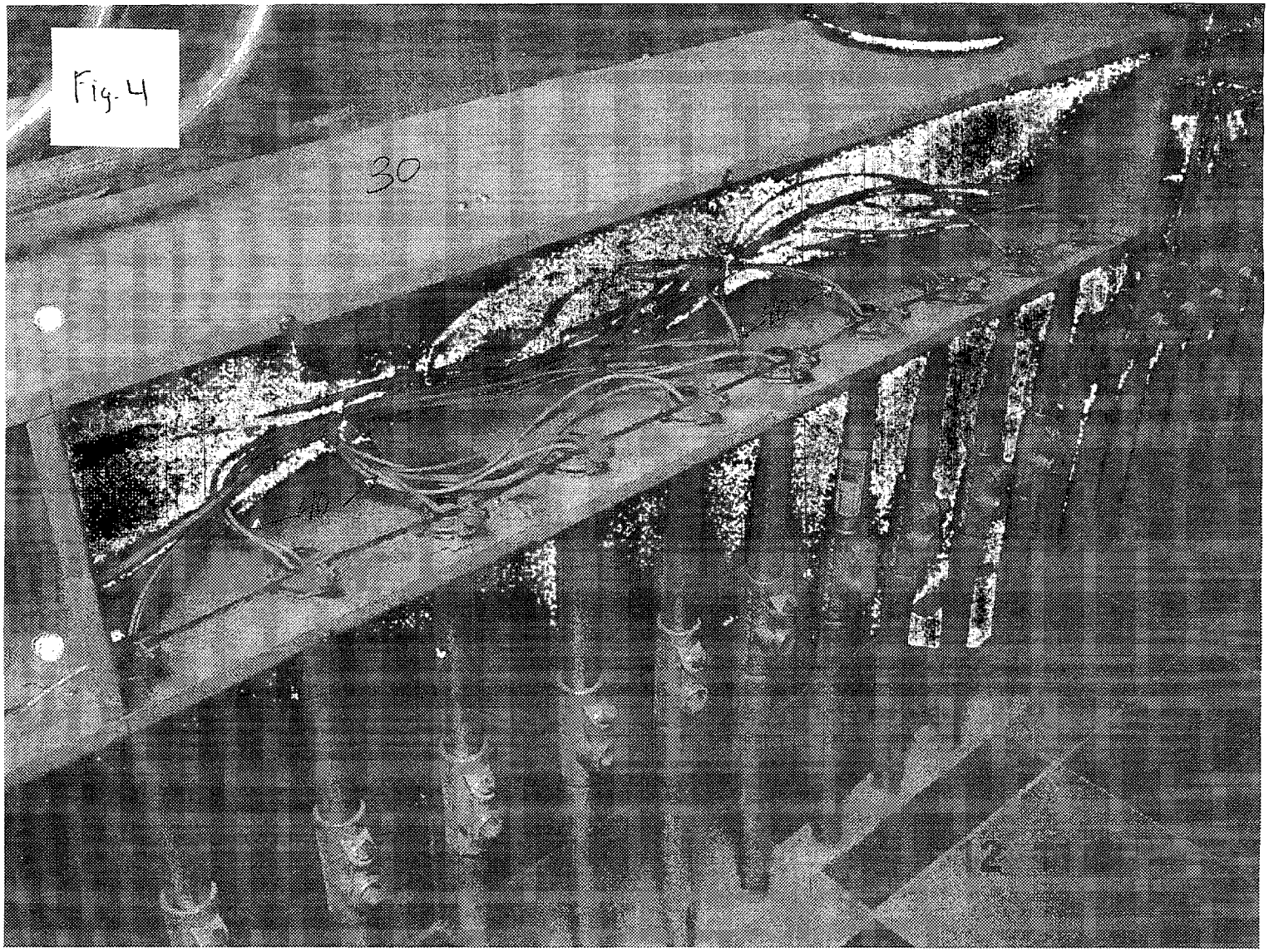
FIG. 4 shows more detail of the layout of electrical systems shown in FIG. 3.

FIG. 4 shows more detail of a typical layout of electrical systems such as that of FIG. 3, wherein the cover is removed from the wire trough 30 exposing the incoming wires 40 from the dispensing units (e.g. card readers and pumps).

With further reference to FIG. 3, also shown are card reader controls 32 and dispenser controls 34. Both the card reader controls 32 and dispenser controls 34 are also known as "D" boxes in the exemplary Gilbarco system shown in FIG. 3. The LVPPS is preferably inserted (i.e., wired in between) the incoming wires 40 and the D boxes, 32, 34, such that the protection is implemented at the first "entrance" of the power upstream of the "D" boxes. This allows the LVPPS to protect the card reader controls 32 and the dispenser controls 34 as well as the ultimate controller (for example, as indicated in FIG. 5 at 50).

Figure 5:
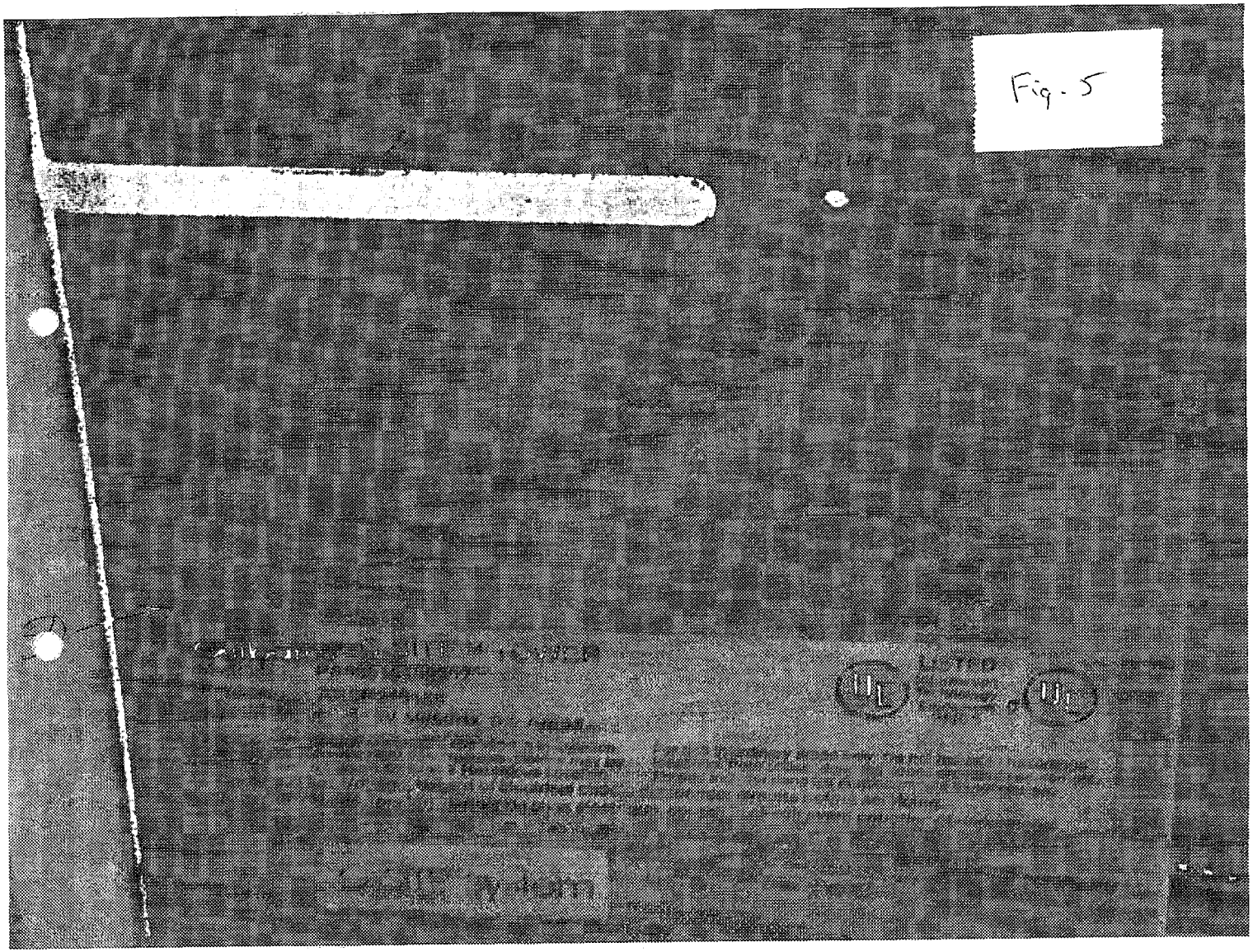
FIG. 5 illustrates an example of an "ultimate controller".

FIG. 5 illustrates an example of an "ultimate controller" as used in accordance with at least one embodiment of the present invention.

Figure 6:
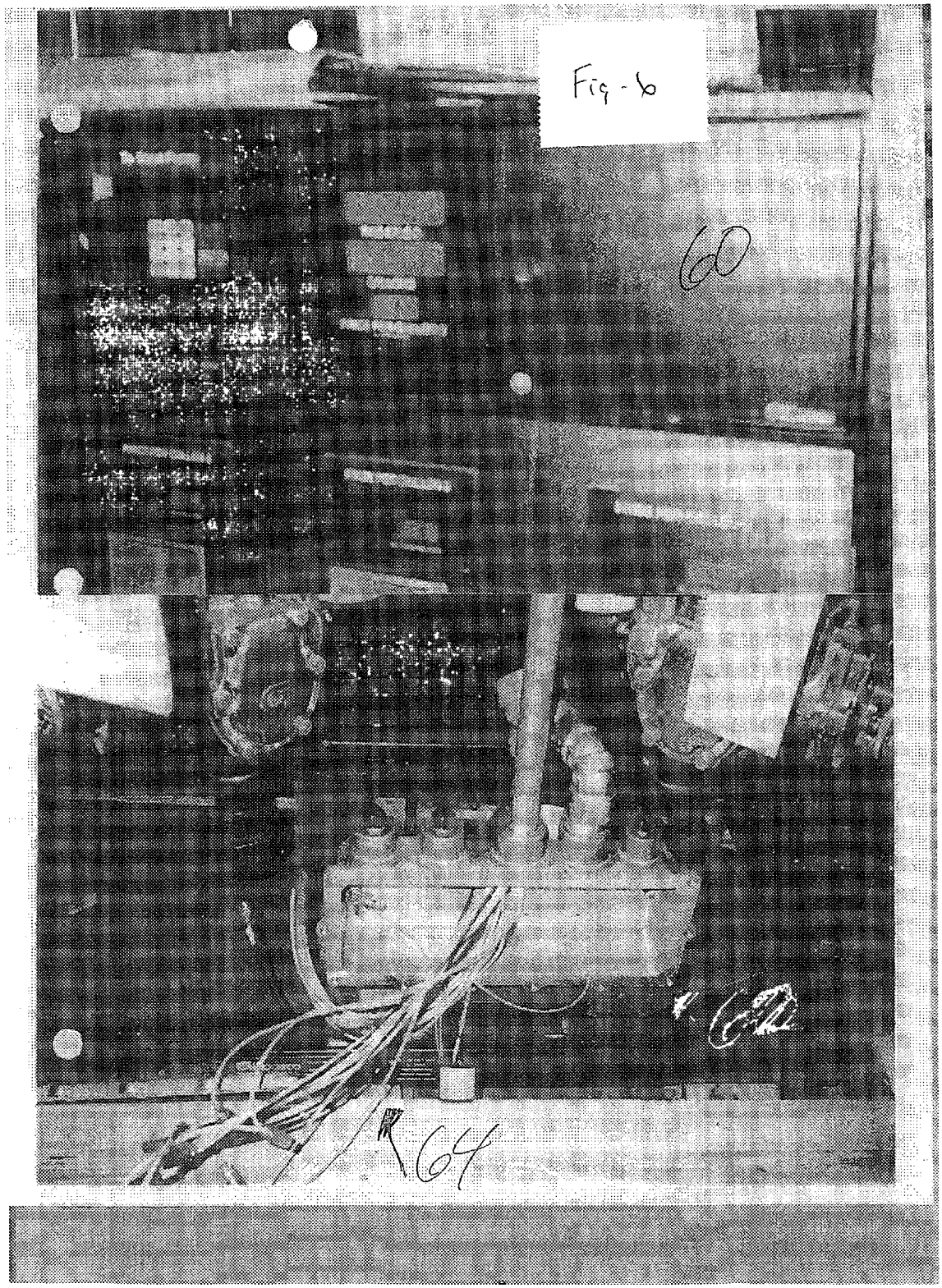
FIG. 6 is a picture of a remote dispenser.

FIG. 6 is a picture of a remote dispenser 60 (gas pump) showing a wire box 62 with the panel removed to expose the outgoing wires 64. The outgoing wires 64 terminate at the wire trough 30 as the incoming wires 40 (as shown in FIGS. 3 and 4).

Figure 7:
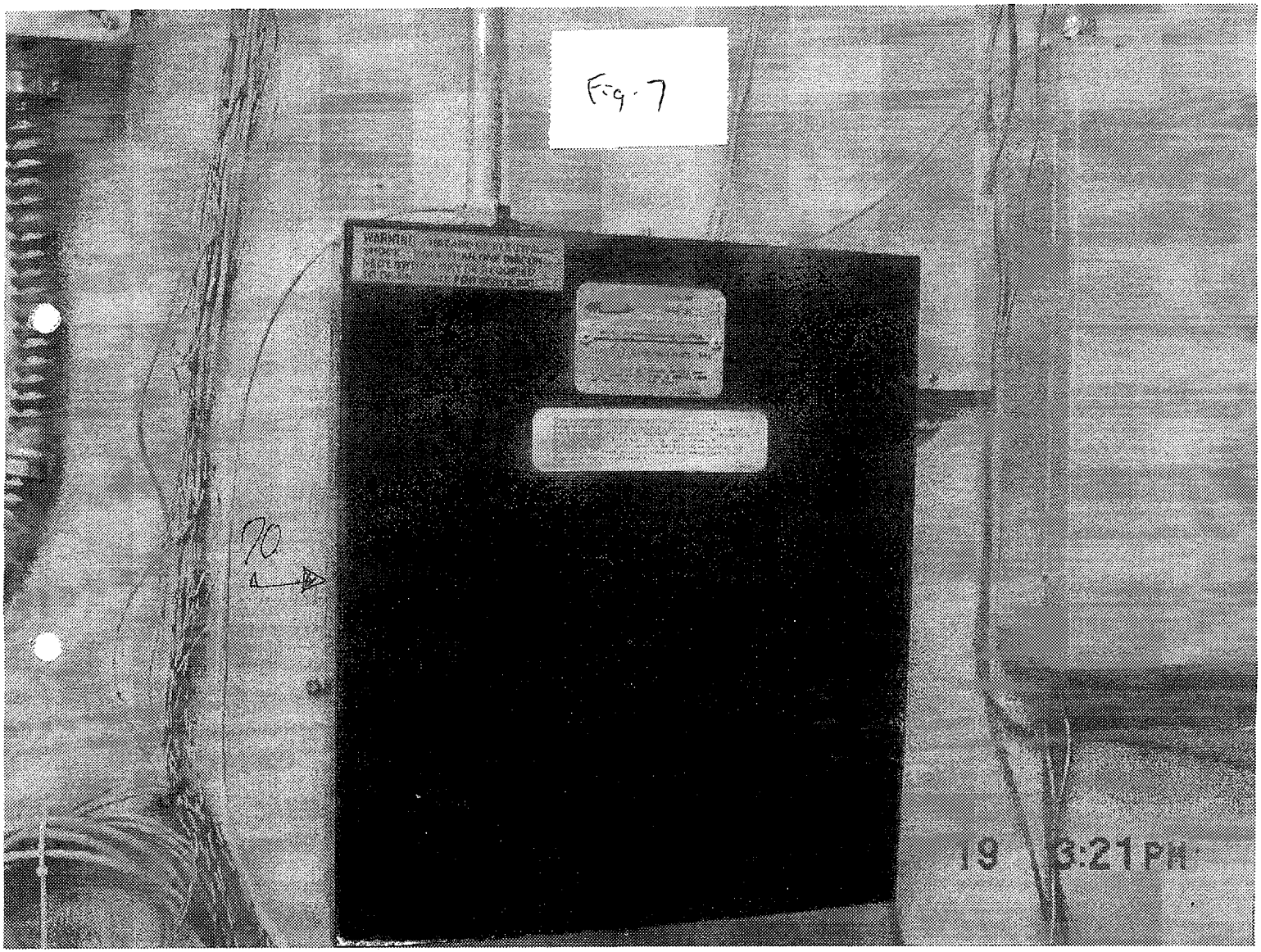
FIG. 7 illustrates a "Tokheim" unit controller.

FIG. 7 is another example of a controller, in this case a Tokheim unit 70 which would be analogous to the "D" boxes of the Gilbarco system.

Figure 8:
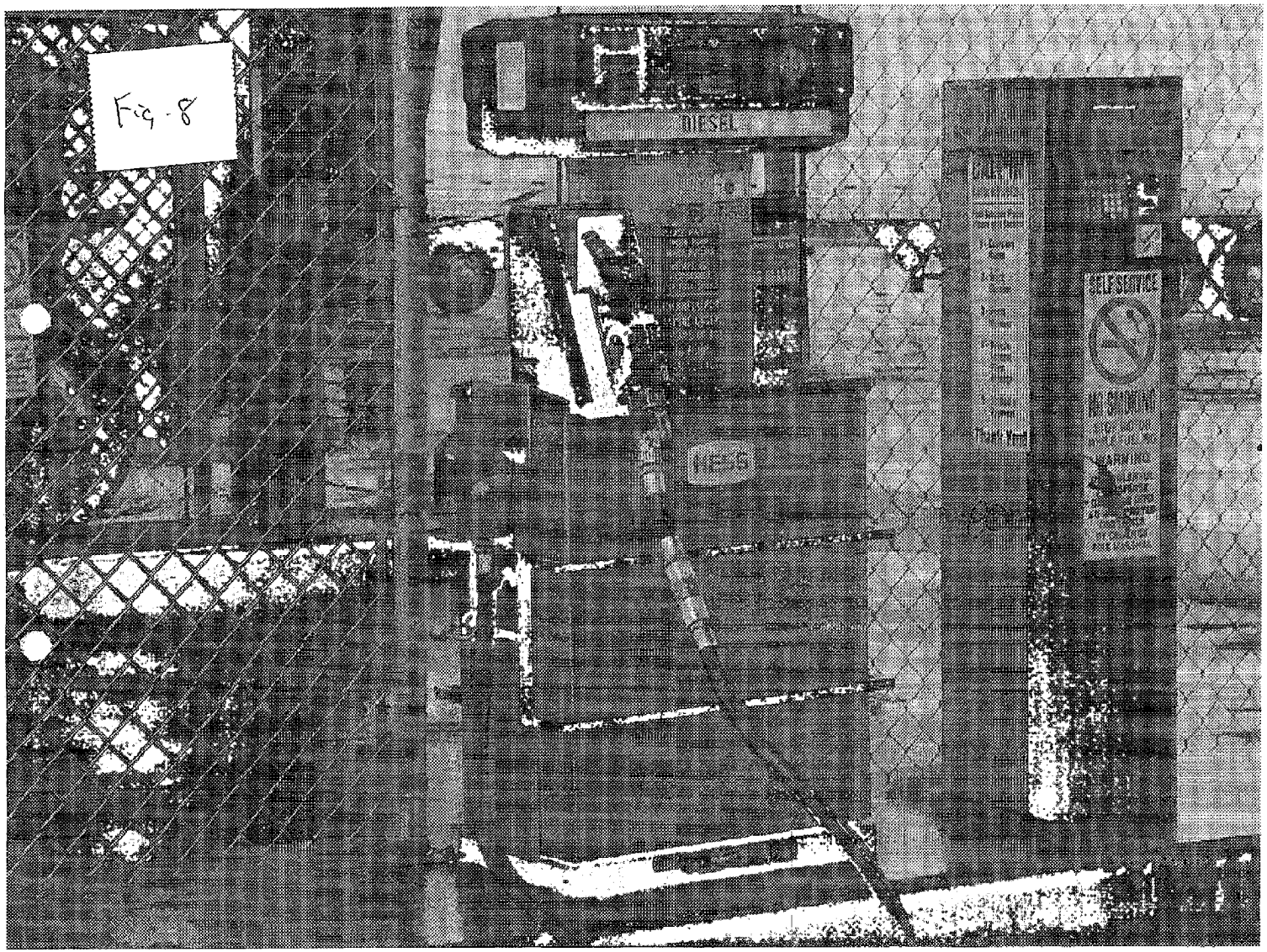
FIG. 8 illustrates a "Trendar" dispensing unit.

FIG. 8 is another example of a different version of a dispensing unit, in this case a Trendar unit, which is a remote card reader.

Figure 9:
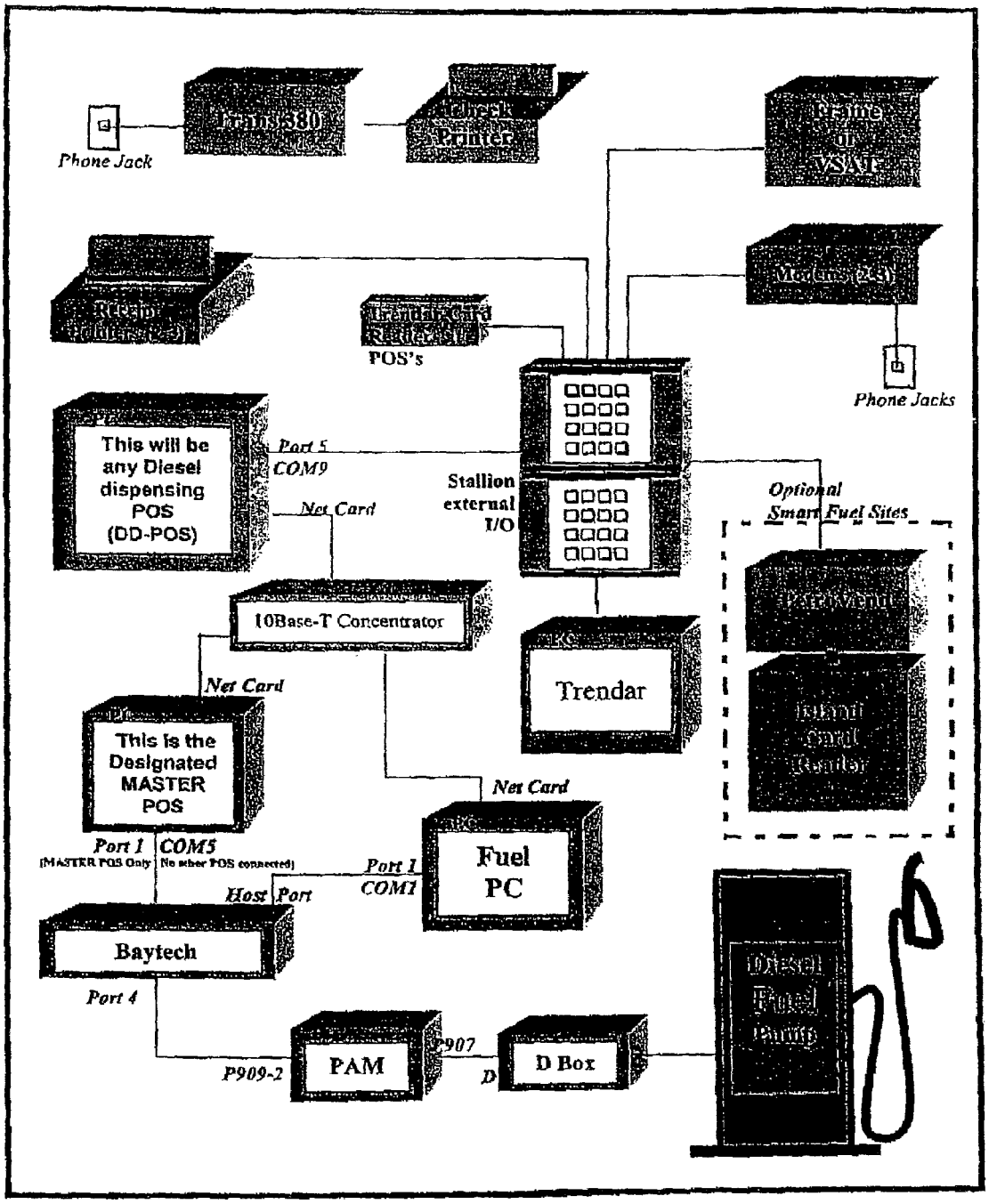
FIG. 9 illustrates a schematic system layout with a Trendar Unit.

FIG. 9 provides a schematic system layout with a known "Trendar"unit in accordance with the invention.

Figure 10:
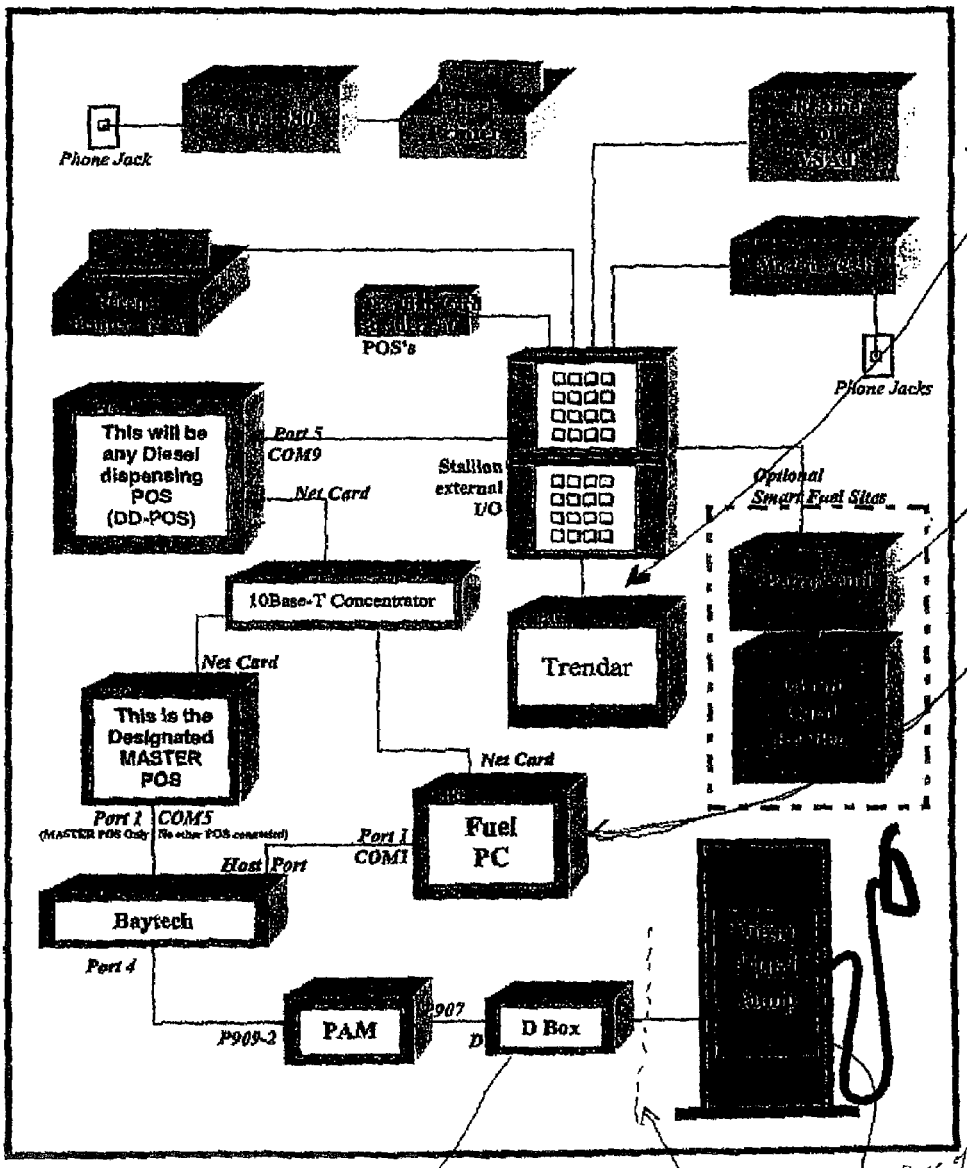
FIG. 10 illustrates a schematic system layout with a Trendar Unit, also showing the placement of a LVPPS in conjunction with other components.

FIG. 10 provides a schematic system layout with a Trendar unit, in accordance with an embodiment of the present invention, showing the placement of the LVPPS in conjunction with other components.

Figure 11:
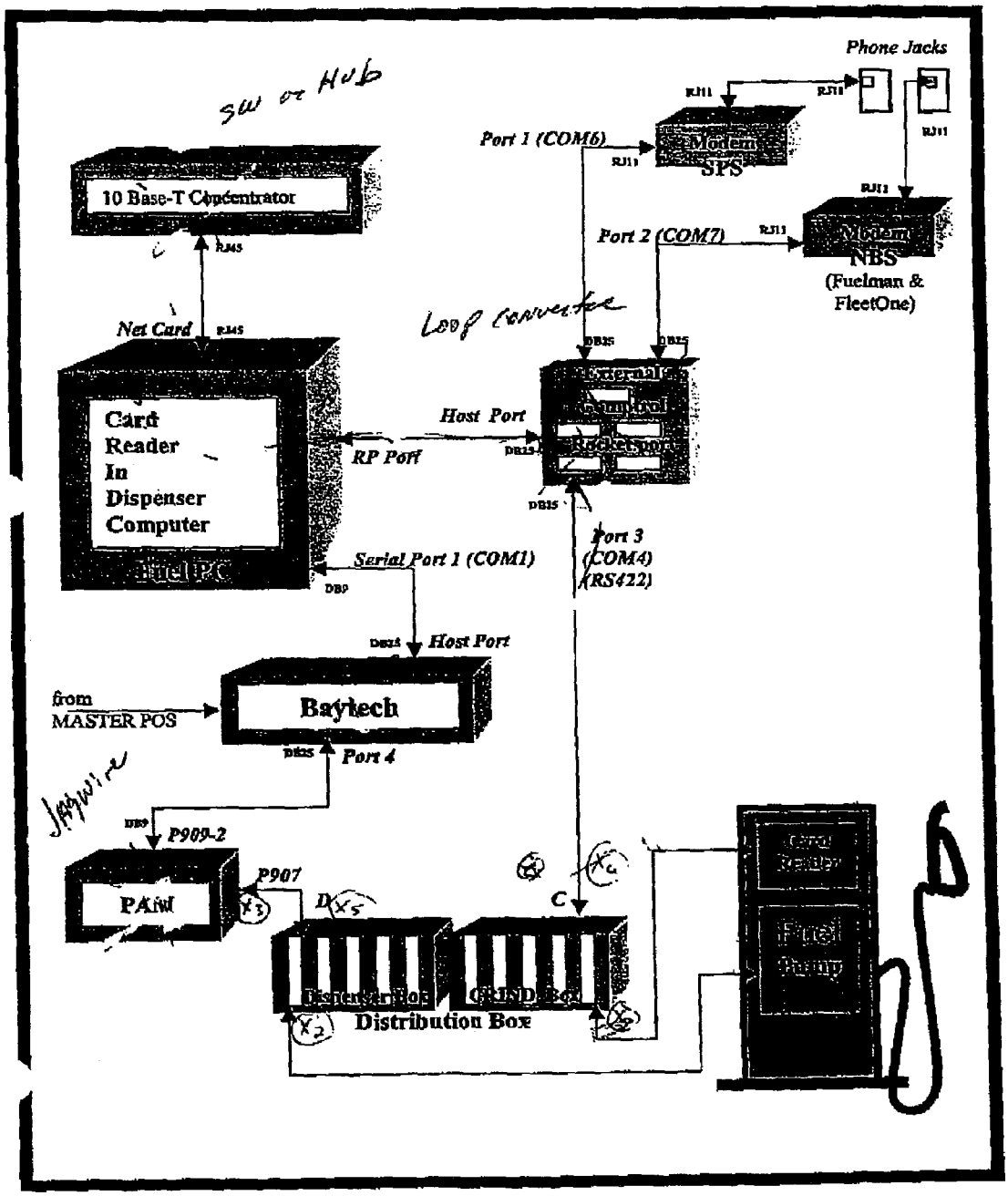
FIG. 11 is a schematic system layout without a Trendar Unit.

FIG. 11 provides a schematic system layout without a Trendar unit, in accordance with an embodiment of the present invention.

Figure 12:
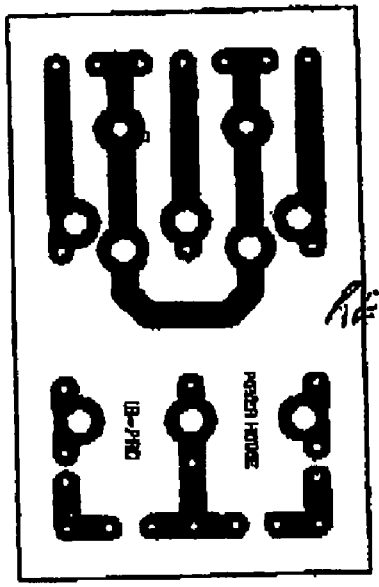
FIG. 12 provides a technical layout detail of a circuit board and module.
Figure 12:
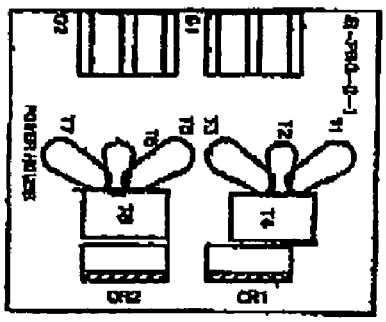

FIG. 12 shows a technical layout detail of a circuit board and module in accordance with an embodiment of the present invention.

One feature inherent in at least one embodiment of the present invention relates to the provision of a low voltage power protection system (LVPPS) that is suitable for use in settings where transient voltage interference is a concern, for example, between dispensers/credit card readers and a central location, such as a truck stop or convenience store.

Another feature inherent in at least one embodiment of the present invention relates to the provision of an LVPPS that has modular components that are easily replaceable by individuals who are not skilled in electrical maintenance, such as clerks or operators at a service station or convenience store.

Another feature inherent in at least one embodiment of the present invention relates to the provision of an LVPPS with modules having built-in visual indicators of continuity (i.e., circuit integrity).

Another feature inherent in at least one embodiment of the present invention relates to the provision of an LVPPS that, upon removal of the modules, maintains and re-establishes the circuit, albeit without surge protection, to allow continuous operation of any remote function (e.g., credit card reading, fuel dispensing, etc.).

Another feature inherent in at least one embodiment of the present invention relates to the provision of an LVPPS that is contained within a unitary assembly such that it can be installed into existing facilities.

Another feature inherent in at least one embodiment of the present invention relates to the provision of an LVPPS unitary assembly with a transparent or translucent cover to allow visualization of the visual indicators of continuity when the cover is in the closed position.

Another feature inherent in at least one embodiment of the present invention relates to the provision of an LVPPS having modular components that are positioned for easy, tool-less removal by an operator or clerk.

Another feature inherent in at least one embodiment of the present invention relates to the provision of an LVPPS which further includes integrated fuses within the replaceable modules.

Another feature inherent in at least one embodiment of the present invention relates to the provision of a system of communications for a plurality of LVPPS' to be electronically connected to a central location for monitoring the continuity status of each module contained in each LVPPS.

In order to fully protect the electronics equipment there is broadly contemplated herein, a 12V DC solution. Particularly, the LVPPS can be adapted for use on 12V DC signal lines that protect equipment after the 110V/220V AC mains and between interfaces and modular equipment.

In more particularity, a preferred embodiment of an LVPPS provides a 12V DC protection system having at least the following features:

a) Modular Din Rail Mounted in a dedicated housing.
b) Individual (2 wire Protection) Module per O & 12V DC.
c) Individual (3 wire Protection) Module per 12, O, 12V DC signals.
d) Each pair of lines is fused and has indicator lights.
e) Similarly, the 12-O-12 Signals have 2 fuses and 2 indicator lights.
f) Easily replaceable modules (i.e. by a lay person/clerk as opposed to a certified electrician/technician).
g) Dispensers out of commission caused by a surge/transient can easily be identified as the indicator light will be non-illuminated, thereby demonstrating a fault.
h) Removal of the surge damaged module will re-activate the dispenser, but no protection will exist until a spare replacement module has been installed.
i) Removal and installation of the modules is very easy and simple (i.e., pull out/push in).
j) It is not possible to push a module in the wrong way. Sockets are coded, i.e. 2 on one side of the module and 3 on the other (2 wire system). Similarly, 3 on one side and 5 on the other for the 3 wire system.

It will be appreciated from the foregoing that there is broadly contemplated herein an arrangement for providing surge protection in a context in which data and/or other electrical impulses must travel over a relatively large distance. A mercantile and/or fuel-dispensing environment is contemplated in particular at the very least because of the significant economic impact that may be brought about by a power surge in such a setting, particularly if the surge is sufficient in conventional circumstances to disable the mercantile or fuel-dispensing system in question.

As such, there is broadly contemplated, in accordance with at least one presently preferred embodiment of the present invention, a surge protection arrangement in which modular, or removable and replaceable, components are provided at a cabinet arrangement such that any disabling surge may be isolated and restricted to a very small number of modules (such as, one module). Such a module, in turn, may be removable and replaceable. In connection with being removed and replaced, while removed the cabinet may still be configured such that the circuit is still complete (albeit without surge protection).

Figure 13:
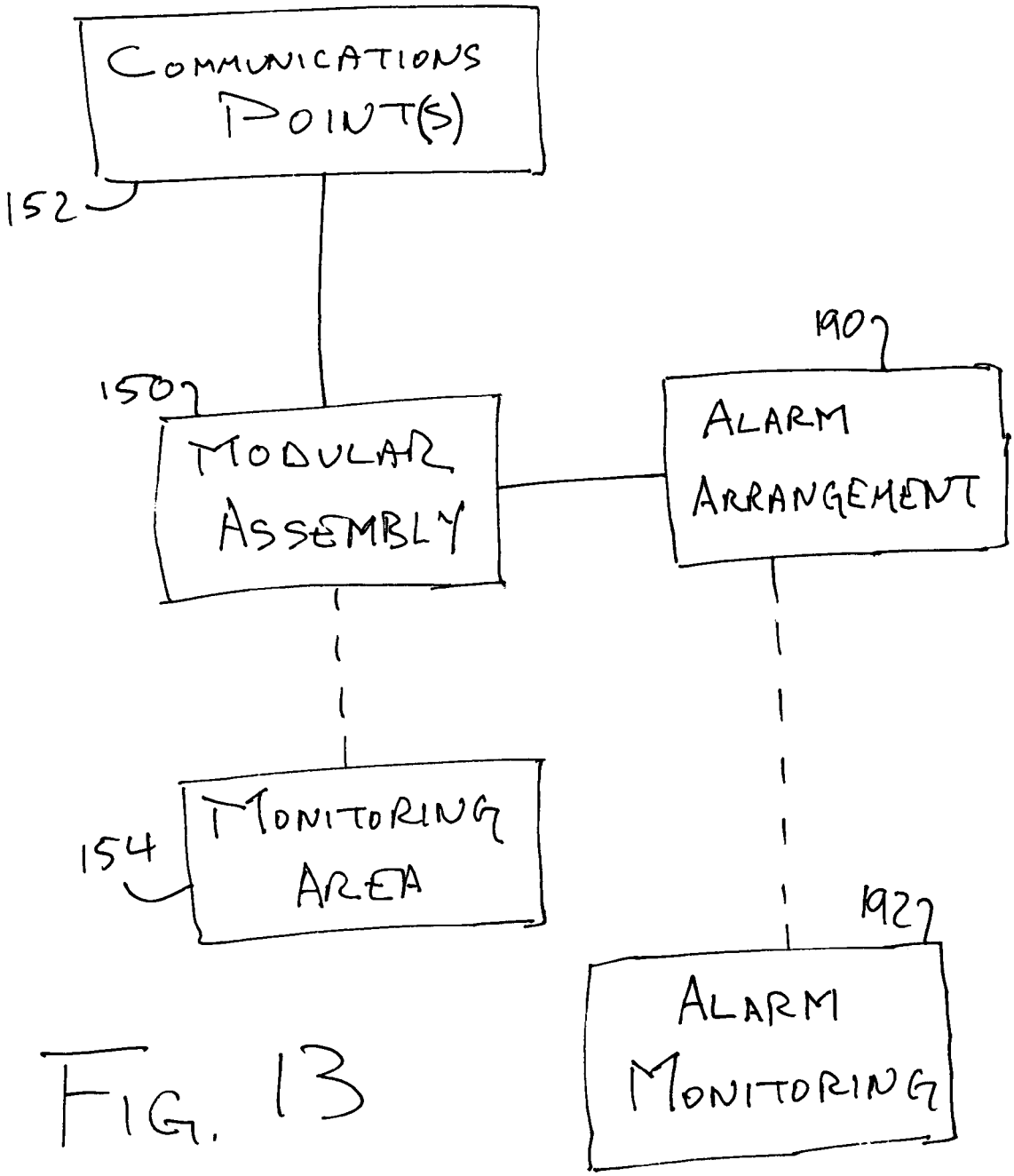
FIG. 13 illustrates a general power protection arrangement.

Turning now to a discussion of some refined features in a general setting such as related heretofore and with reference to FIG. 13, there is broadly contemplated herein a modular system or assembly for providing surge protection. Such a modular system can be employed in a wide variety of environments, such as general mercantile and fuel dispensing settings. In the case of fuel dispensing, it is conceivable for each module in a group of modules to correspond to a single communications point among one or more such points (152), e.g., a fuel pump or a credit card/debit card reader present at a fuel pump. Although essentially any number of modules may be present in an assembly 150, it is often the case that a cabinet may contain 8 or 16 modules. On the other hand, in a setting where there may be essentially only one card reader or communications point (at 152), such as a communications point at an automated car wash (e.g., where a car driver may punch in a code to start a car wash session and/or render payment with cash or a credit or debit card), an assembly 150 may have only one module that corresponds to the sole communications point involved. A similar setup may prevail in fuel dispensing settings where only one fuel pump is present to begin with or, more commonly, where one fuel pump is distinguishable from others because of a unique type of fuel being dispensed (e.g., a diesel fuel pump at a service station that otherwise offers gasoline pumps; this corresponds to the known "Trendar" unit, for instance).

In whatever setting prevails, it will normally be the case that a monitoring area or the like (154) will be present in a remote (likely enclosed) location. At such a monitoring area 154 (e.g., the area behind the counter at a convenience store), an operator or employee typically will be able to monitor, e.g., which fuel pump(s) is/are currently in use. A cabinet containing one or more modules in accordance with at least one embodiment of the present invention may be located in the general monitoring area or may be present at another location.

Figure 14:
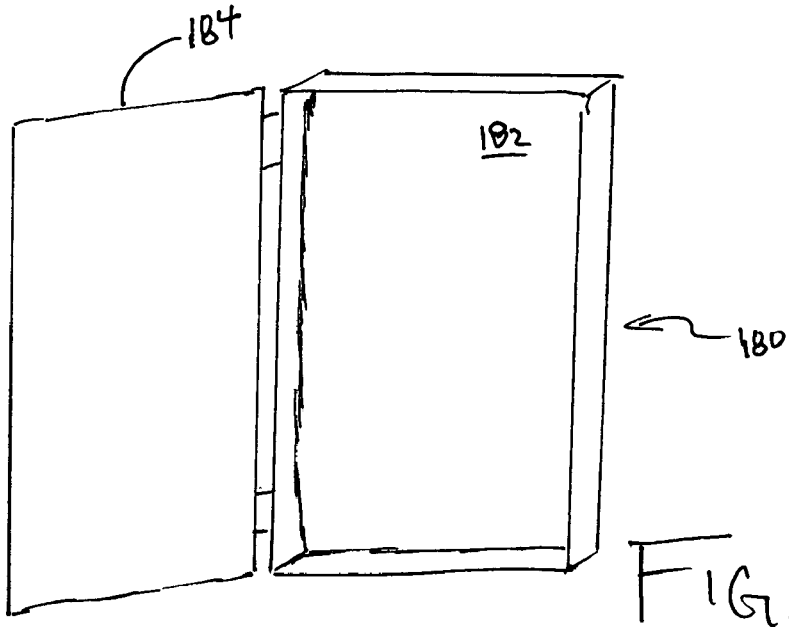
FIG. 14 illustrates a cabinet for containing modules.

FIG. 14 schematically illustrates a modular assembly in the form of a cabinet 180 in accordance with an embodiment of the present invention. A back interior surface 182 of cabinet 180 will preferably include base assemblies for modules, as discussed further below. Preferably, cabinet 180 may have a clear cover 184 that is easily swung out or removed; as such, an operator or employee may visually take note of module conditions without opening the cover.

Figure 15:
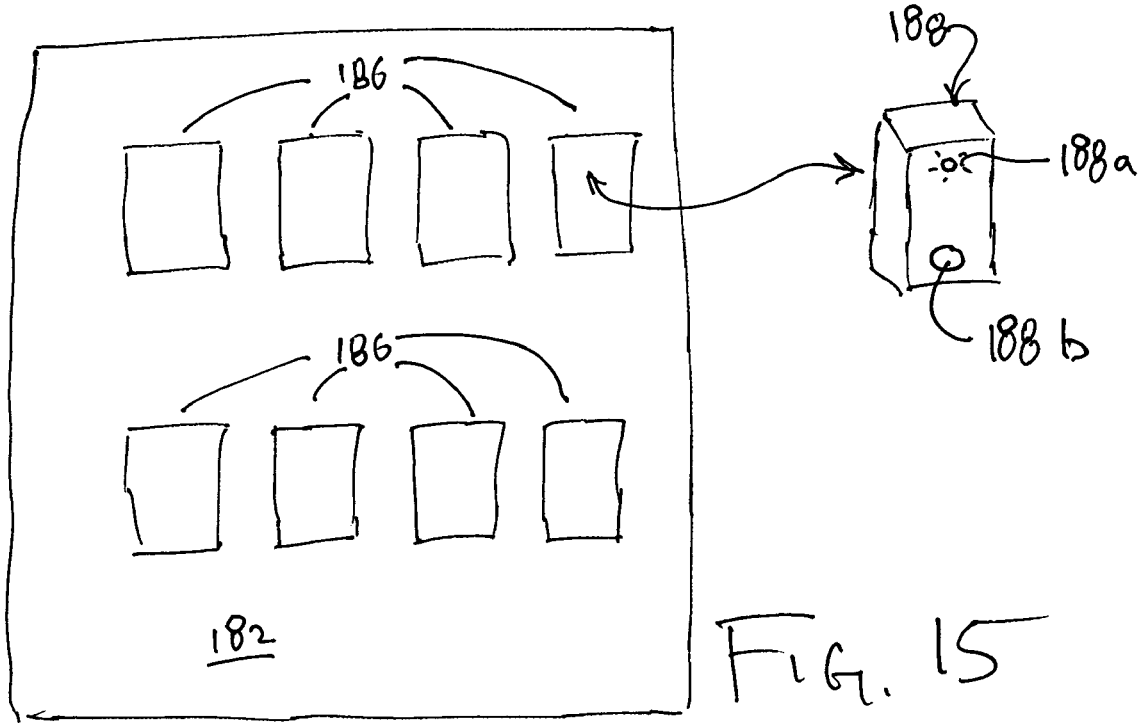
FIG. 15 illustrates an array of modular base assemblies.

As shown in FIG. 15, an array of individual "base assemblies" 186, or docking areas for individual modules, is present. An individual module 188 can thus preferably be connectable with, and "dockable" within, a corresponding base assembly 186. During normal operation, each module 188 is docked in its corresponding base assembly 186. In accordance with a particularly advantageous refinement of the present invention, at least one of a fuse 188*b* and an indicator light 188*a* (e.g., an LED) may be built in to each module 188. Preferably, each indicator light 188*a* will be "on" or "activated" for as long as active communication is maintained with the corresponding remote communications point or mercantile element (e.g., fuel dispenser or card reader; see FIG. 13) and the corresponding circuit is not broken. On the other hand, in response to a power surge, the resulting broken circuit (corresponding to a given remote communications point or mercantile element) will ensure that the indicator light 188*a* goes off.

It should be appreciated that when an indicator light 188*a* goes off, a variety of conditions might be involved, such as a blown fuse, a disconnected circuit or a burned-out indicator light. However, since the indicator light 188*a* and fuse 188*b* are now part of the modular structure, an operator or employee need only remove the entire module 188 since the problem to be addressed will be contained within the space of that single module. This contrasts with an arrangement where a fuse, e.g., is not integral with a module and an inactive indicator light does not distinguish between a problem with the fuse and a problem with the modular circuit. In such an arrangement, it would be necessary to remove both the fuse and the modular circuit to ensure that the attendant problem would be resolved.

When an operator or employee removes a "sick" module 188, as discussed heretofore, the general circuit which interconnects multiple modules (among base assemblies 186) will still be "made", albeit without surge protection. It would then be contingent upon an operator/employee to insert a replacement module in the corresponding "empty" base assembly 186 in place of the "sick" module that was removed. The "sick" module, for its part, can be appropriately attended to and repaired separately (whether that involves merely replacing a fuse or repairing a circuit or the indicator light) before being reinserted into the cabinet structure, or may be discarded. Appropriate diagnostics may be employed in such attention and repair.

Reverting to FIG. 13, in accordance with an advantageous refinement of the present invention, an alarm arrangement 190 may be provided to provide an alert that a module has been removed from a cabinet. This would be particularly advantageous when considering that even a "made" circuit with one or more modules missing will likely be vulnerable to additional power surges, wherein even just one more power surge could render the entire system completely inoperable. Accordingly, via suitable circuitry and/or switching arrangements (which will clearly be within the purview of those of ordinary skill in the art), upon removal of a module from a base assembly, a signal may be sent to a remote location (such as a central corporate location) 192 to provide one type of alarm or alert, or another. Such alarms or alerts could take a wide variety of forms at the alarm monitoring location 192 in question, which include (but are by no means limited to): a visual signal (such as a static or flashing light), an audible signal, or an automatically generated email message.

As can be generally appreciated herein, the embodiments of the present invention can be employed in a very wide variety of contexts. In a "Gilbarco", or "2-wire" system, each base assembly and module corresponds to one communications point or mercantile element (e.g., fuel dispenser or card reader). In a "Tokheim" or "3-wire" system, two base assembly spaces are typically required for each module. The embodiments of the present invention are sufficiently versatile to readily adopt both systems, along with many others.

By integrating a fuse into a module as broadly contemplated herein, it will be appreciated that the fuse is directly tied in to the module circuit. This more tightly integrated structure (as compared with a structure involving a fuse separate from a module) will actually ensure that there are fewer circuit connections where a failure can even take place. The same can be said of an indicator light which is integrated into a modular structure in accordance with at least one embodiment of the present invention; fewer circuit connections result as compared with an arrangement where a light is not integrated with a module. Overall, by integrating an indicator light and/or a fuse into a module, the chance that some type of loose or faulty wiring will cause a circuit failure is greatly decreased, in view of the reduced number of circuit connection points.

Modular arrangements such as those broadly contemplated herein are of course capable of being employed in a wide variety of communication/circuitry formats. Such formats may include, but of course are by no means limited to, a 4-20 milliamp loop, a 45 milliamp loop and any of a wide variety of signal levels and/or communications protocols, such as RS485, RS422 and RS232.

Individual modules, and their base assemblies, and other constituent components of both, can be configured in essentially any suitable manner with a view to supporting the inventive features contemplated herethroughout. In this connection, particularly favorable results have been enjoyed in connection with modular and modular base assembly components manufactured by Powerhouse Electronics of Durban, South Africa; a Powerhouse Electronics catalog containing several sample components is included by way of background material in the corresponding U.S. Provisional Patent Application Ser. No. 60/566,631.

By way of overall, but by no means exhaustive, recapitulation, a Low Voltage Power Protection System (LVPPS) is broadly contemplated herein for protection against an electrical transient surge and/or interference. Such a LVPPS can be useful in the dispensing of fuel at gas stations, convenience stores, truck stops, and other such locations, for protection of the low voltage signal wires that go from the dispenser to the store. Signal wires in such environments are often subject to transient voltage disturbance and/or damage that would easily be protected by an LVPPS in accordance with embodiments of the present invention.

It will further be appreciated from the foregoing that one desired objective herein is to provide a low voltage power protection system (LVPPS) that is suitable for use in settings where transient voltage interference is a concern, for example, between dispensers/credit card readers and a central location, such as a truck stop or convenience store.

Another objective herein is to provide an LVPPS that has modular components that are easily replaceable by clerks and operators that are not skilled in electrical maintenance.

Another objective herein is to provide an LVPPS with modules having built-in visual indicators of continuity.

Another objective herein is to provide an LVPPS that, upon removal of the modules, maintains and re-establishes the circuit, albeit without protection, to allow continuous operation of the remote function (e.g., credit card reading, fuel dispensing, etc.).

Another objective herein is to provide an LVPPS that is contained within a unitary assembly such that it can be installed into existing facilities.

Another objective herein is to provide an LVPPS unitary assembly with a transparent or translucent cover to allow visualization of the visual indicators of continuity when the cover is in the closed position.

Another objective herein is to provide an LVPPS having modular components that are positioned for easy, tool-less removal by an operator or clerk.

Another objective herein is to provide an LVPPS which further includes integrated fuses within the replaceable modules.

Another objective herein is to provide a system of communications for a plurality of LVPPS' to be electronically connected to a central location for monitoring the continuity status of each module contained in each LVPPS.

Without further analysis, the foregoing will so fully reveal the gist of the present invention and its embodiments that others can, by applying current knowledge, readily adapt it for various applications without omitting features that, from the standpoint of prior art, fairly constitute characteristics of the generic or specific aspects of the present invention and its embodiments.

If not otherwise stated herein, it may be assumed that all components and/or processes described heretofore may, if appropriate, be considered to be interchangeable with similar components and/or processes disclosed elsewhere in the specification, unless an express indication is made to the contrary.

If not otherwise stated herein, any and all patents, patent publications, articles and other printed publications discussed or mentioned herein are hereby incorporated by reference as if set forth in their entirety herein. Specifically, U.S. Pat. Nos. 5,774,317, 4,907,119 and 5,956,223 are hereby incorporated by reference as if set forth in their entirety herein, as well as U.S. Provisional Patent Application Ser. No. 60/566,631, filed on Apr. 28, 2004 (from which the instant application claims priority).

It should be appreciated that the apparatus and method of the present invention may be configured and conducted as appropriate for any context at hand. The embodiments described above are to be considered in all respects only as illustrative and not restrictive. All changes which come within the meaning and range of equivalency of the claims are to be embraced within their scope.

What is claimed is:

1. A power protection arrangement comprising;

an assembly comprising at least one modular base assembly;

at least one power protection module adapted to be docked at and removable from said at least one modular base assembly; and at least one visual indicator corresponding to said at least one power protection module, said at least one visual indicator being adapted to indicate a state of communicative integrity between said assembly and at least one remote communications point;

said assembly being adapted to maintain or reestablish circuit integrity upon removal of at least one said power protection module from at least one said modular base assembly.

2. The power protection arrangement according to claim 1, wherein each said at least one visual indicator is physically integrated with a corresponding power protection module.

3. The power protection arrangement according to claim 1, further comprising at least one fuse corresponding to said at least one power protection module.

4. The power protection arrangement according to claim 3, wherein each said fuse is physically integrated with a corresponding power protection module.

5. The power protection arrangement according to claim 4, wherein each said at least one visual indicator is physically integrated with a corresponding power protection module.

6. The power protection arrangement according to claim 1, further comprising an alarm arrangement for prompting an alarm upon removal of at least one power protection module from at least one modular base assembly.

7. The power protection arrangement according to claim 6, wherein said alarm arrangement is adapted to transmit an alarm indicator to a remote location upon removal of at least one power protection module from at least one modular base assembly.

8. The power protection arrangement according to claim 7, wherein the alarm indicator comprises an automatically generated email message.

9. The power protection arrangement according to claim 1, wherein the at least one remote communications point comprises at least one fuel dispensing arrangement.

10. The power protection arrangement according to claim 1, wherein the at least one remote communications point comprises at least one credit or debit card reader.

11. The power protection arrangement according to claim 1, wherein the at least one remote communications point comprises at least one communications point corresponding to an automatic vehicle washing arrangement.

12. The power protection arrangement according to claim 1, wherein each said at least one power protection module is removable from said at least one modular base assembly without tooling.

13. The power protection arrangement according to claim 1, wherein said assembly comprises a cabinet which houses said at least one modular base assembly.

14. The power protection arrangement according to claim 13, wherein said cabinet comprises a transparent cover.

15. A power protection arrangement comprising;

an assembly comprising at least one modular base assembly; and at least one power protection module adapted to be docked at and removable from said at least one modular base assembly;

said assembly being adapted to maintain or reestablish circuit integrity upon removal of at least one said power protection module from at least one said modular base assembly.

* * * * *